US005568916A

United States Patent [19]

Gibbons et al.

[11] Patent Number: 5,568,916

[45] Date of Patent: Oct. 29, 1996

[54] QUICK SET AND RELEASE CLAMPING DEVICE

[76] Inventors: Robert R. Gibbons, 3842 Renee Dr., Bismarck, N. Dak. 58501; Kenneth F. Halls, 6972 W. 76th Ave., Arvada, Colo. 80003

[21] Appl. No.: 368,360

[22] Filed: Jan. 4, 1995

[51] Int. Cl.[6] ..... B25B 1/02

[52] U.S. Cl. ..... 269/174; 269/249

[58] Field of Search ..... 269/249, 173–182; 411/433, 437

[56] References Cited

U.S. PATENT DOCUMENTS

| | | | |
|---|---|---|---|
| 686,924 | 11/1901 | Cramer | 269/174 |
| 1,846,422 | 2/1932 | Hands | 269/249 |
| 2,156,195 | 4/1939 | Robillard | 269/249 |
| 2,705,983 | 9/1955 | Guadagna | 269/174 |
| 5,423,525 | 6/1995 | Spainhower | 269/249 |

*Primary Examiner*—Robert C. Watson

*Attorney, Agent, or Firm*—David A. Lingbeck

[57] ABSTRACT

A quick set and release clamping device comprising a frame having an inner leg and an outer leg fixedly spaced from each other, a threaded rod freely movable through a transverse bore in the end portion of the inner leg, a first work piece engaging member fixedly attached to the end of the outer leg, a second work piece engaging member swivelly connected to the threaded rod, a pair of rod engageable half bodies slidable in a tapered end of the transverse bore for engaging the threaded rod, a retaining cover to house and restrict movement of the rod engageable half bodies, a detent to urge the half bodies into the seat portion of the transverse bore and to engage the threaded rod, a spring to urge the rod engageable half bodies slightly out of the tapered end of the transverse bore, a biased element for urging separation of the rod engageable half bodies, and a spring member to urge the detent against the cover. The rod engageable half bodies provide threaded surfaces to urge and grip the threaded rod into a clamping position in cooperation with the first work piece engaging member.

11 Claims, 4 Drawing Sheets

QUICK SET AND RELEASE CLAMPING DEVICE

BACKGROUND OF THE INVENTION

This invention relates to a quick set and release clamping device which allows the user to quickly set the threaded rod into engagement with a work piece in cooperation with the frame of the clamping device and to quickly release the threaded rod from engagement with the work piece.

Clamping devices are used to hold a work piece so that some sort of work can be performed on the work piece without worry that the work piece will move. Clamping devices have been used for years as the following disclosure of pertinent prior art indicates:

One known prior art is a ONE HAND HELD AND OPERATING CLAMP, U.S. Pat. No. 4,185,811, INVENTED BY HOWARD W. LONG, which comprises a frame having fixed jaw mounted thereon, a moveable jaw attached to a plunger, a clutch mechanism to control the plunger for clamping the moveable jaw in cooperation with the fixed jaw, and a button to control the clutch mechanism.

Another known prior art is a ONE-HAND OPERATED, RATCHET-ACTUATED, QUICK-SET C-CLAMP, U.S. Pat. No. 4,220,322, INVENTED BY HAROLD W. HOBDAY, which according to the title comprises a ratchet and pawl mechanism to set the clamp.

Another known prior art is a CLAMP FOR PICTURE FRAME TOOL AND OTHER PURPOSES, U.S. Pat. No. 5,096,170, INVENTED BY STEPHEN D. ALBIN, which comprises two jaws, a sleeve to which one of the jaws is attached, a rod is which the other jaw is attached, and a lever which causes the rod to reciprocate.

Another known prior art is a ONE HAND CLAMPING DEVICE, U.S. Pat. No. 4,436,294, INVENTED BY ROBERT L. IRELAN, which comprises a C-shaped clamping structure, an actuating grip together with a quandrant segment gear, and a rack bar which is driven by the gear.

Another known prior art is a CLAMP, U.S. Pat. No. 4,893,801, INVENTED BY ROBERT W. FLINN, which comprises a stationary jaw and a moveable jaw carried on support arms, and a pressure arm which is advanced by a ratchet mechanism.

Another known prior art is a QUICK-ACTION BAR CLAMP, U.S. Pat. No. 4,926,722, INVENTED BY JOSEPH A. SORENSON, which comprises a fixed jaw and a moveable jaw which is attached to a slide bar, a one-way drive means which engages the slide bar and advances the moveable jaw, and a braking lever for preventing reverse motion of the slide bar.

Another known prior art is a CLAMPING DEVICE, U.S. Pat. No. 5,161,787, INVENTED BY HAROLD W. HOBDAY, which comprises a clamp body, and a stem which is advanced by a setting mechanism which has a hand lever and hand grip.

Another known prior art is a QUICK RELEASE C-CLAMP, U.S. Pat. No. 5,217,213, INVENTED BY LIANG-KUEN LII, which comprises a ratchet-surfaced rod, a pawl for advancing the rod, a catch for preventing backward movement of the rod, and a handle for actuating the pawl.

None of the prior art above-noted anticipates or suggests the present invention which provides a threaded surface for preventing slippage or backward movement of the rod during the clamping of a work piece. The prior art discloses inventions which have ratcheted surfaces on one side of the stem or rod, which cannot be finely tuned nor provide the clamping strength as that of threaded surfaces.

SUMMARY OF THE INVENTION

The present invention relates to a quick set and release clamping device comprising a frame having an inner leg and an outer leg, a threaded rod freely movable through a transverse bore which extends through the end portion of the inner leg and which has a tapered portion in the inner side of the inner leg defining a seat portion, and a means to engage and disengage the threaded rod and to effect clamping of a workpiece by the threaded rod.

One objective of the present invention is to provide a quick set and release clamping device which allows the user to freely move the threaded rod back and forth without having to turn the threaded rod in or out.

Another objective of the present invention is to provide a quick set and release clamping device which will save many manhours for the user since the user can disengage the threaded rod and freely move the threaded rod to either engage the workpiece or release the workpiece with having to thread the rod all the way in or all the way out.

Also, another objective of the present invention is to provide a quick set and release clamping device which has more clamping strength than the clamping devices having the ratchet and pawl mechanisms because more of the surface area of the rod is being engaged in the present invention than in the prior art.

Yet, another objective of the present invention is to provide a quick set and release clamping device which can be tightened or loosened fractionally because the threaded rod can be slightly turned in or out thus providing more clamping strength than the prior art which can only be adjusted from one tooth to the next on the ratchet surface.

Further objectives and advantages of the present invention will become apparent as the description proceeds and when taken in conjunction with the accompanying drawings wherein:

DETAILED DESCRIPTION OF THE INVENTION

Figure 3:
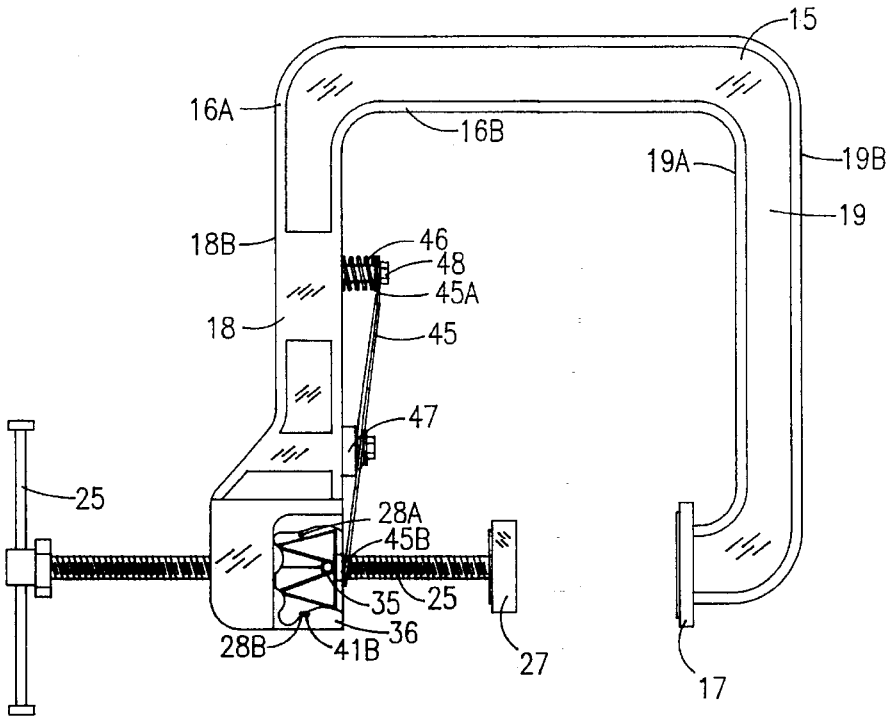
FIG. 3 is a side elevational view of the clamping device with the retaining cover partially cut away to show how the rod engageable means seats in the seat portion of the transverse bore.
Figure 1:
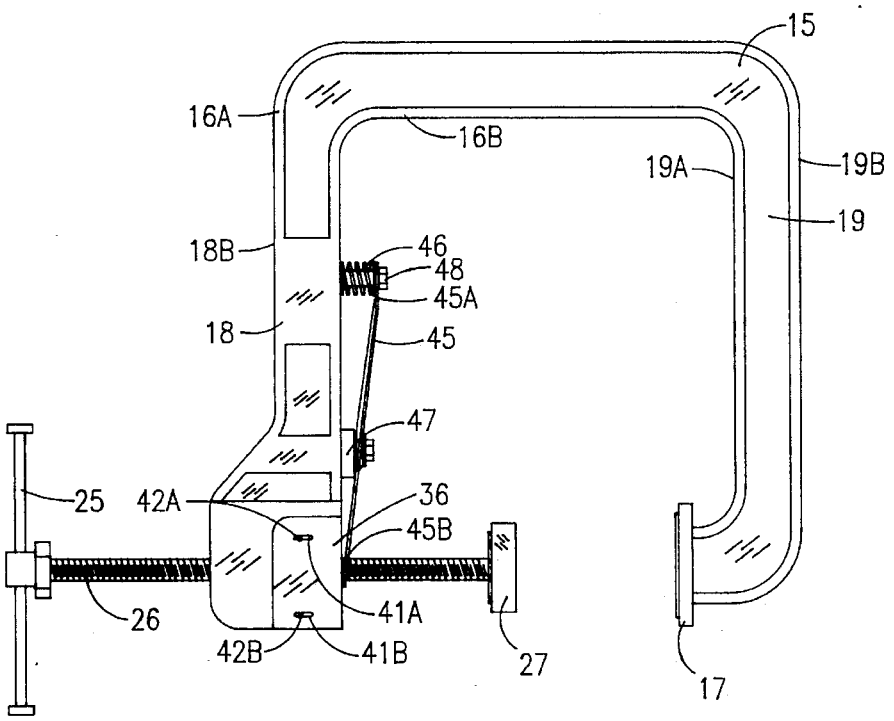
FIG. 1 is a side elevational view of the quick set and release clamping device.

Referring to the drawings in FIGS. 1–6, in particular, the quick set and release clamping device 10 comprises a frame 15 preferably made of metal and being generally C-shaped and further having an outer leg and an inner leg 18 fixedly spaced apart from one another at their ends to receive a workpiece therebetween, both legs having inner sides 18*a* & 19*a* which face each other and also having outer sides 18*b* & 19*b*. The frame 15 further has reinforcing ribs 16*a* & 16*b* extending about the perimeters of the inner and outer legs to strengthen the frame 15 and prevent the frame 15 from breaking under torque pressures exerted upon the frame 15. A conventional first workpiece engaging member 17 preferably a disc-shaped member is fixedly attached to near the end of the outer leg and is disposed generally facing the inner leg 18. A threaded rod 25 is freely movable through a transverse bore 20 which extends through the end portion of the inner leg 18 from the inner side 18*a* to the outer side 19 with the longitudinal axis of the bore being generally perpendicular to the outer leg.

Figure 2:
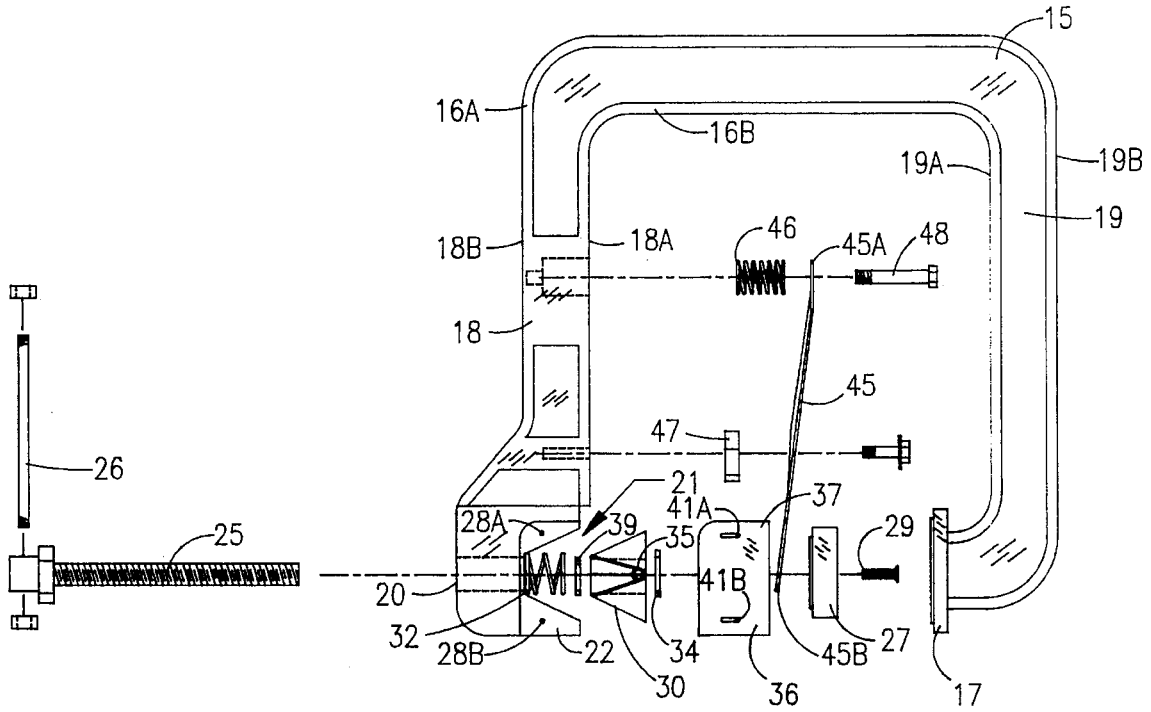
FIG. 2 is an exploded side elevational view of the clamping device.
Figure 4:
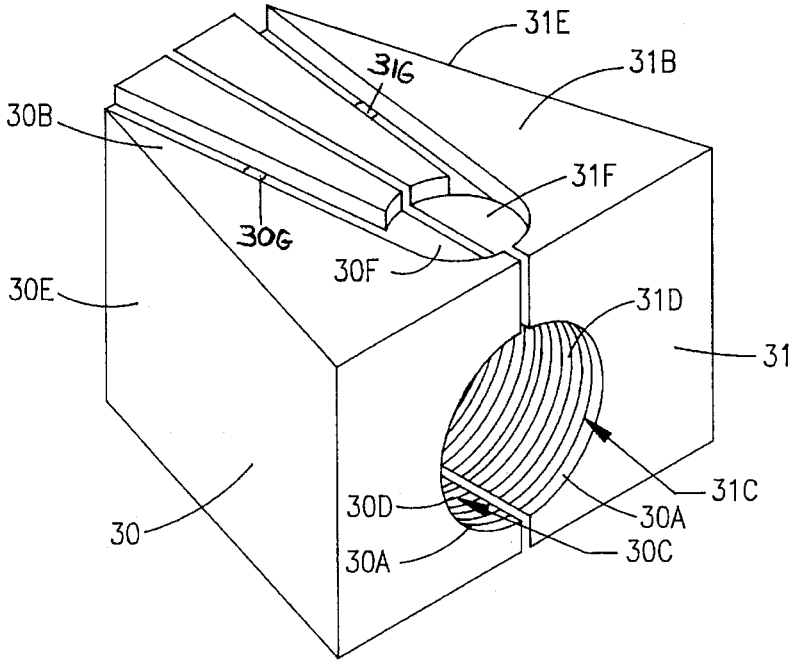
FIG. 4 is a detail view of the rod engageable means of the clamping device in a rod disengaging separation.
Figure 5:
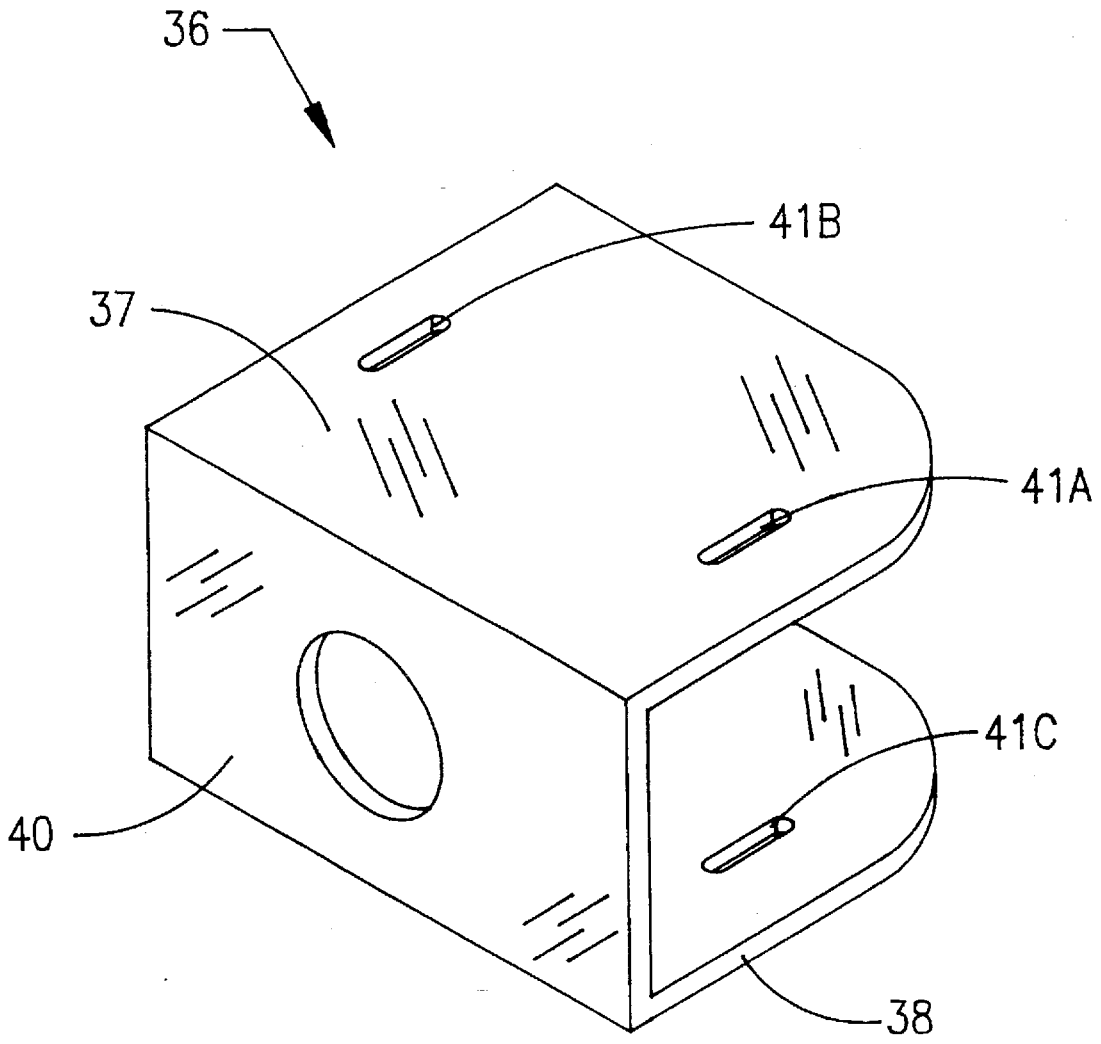
FIG. 5 is a detail back perspective view of the retaining cover of the clamping device
Figure 6:
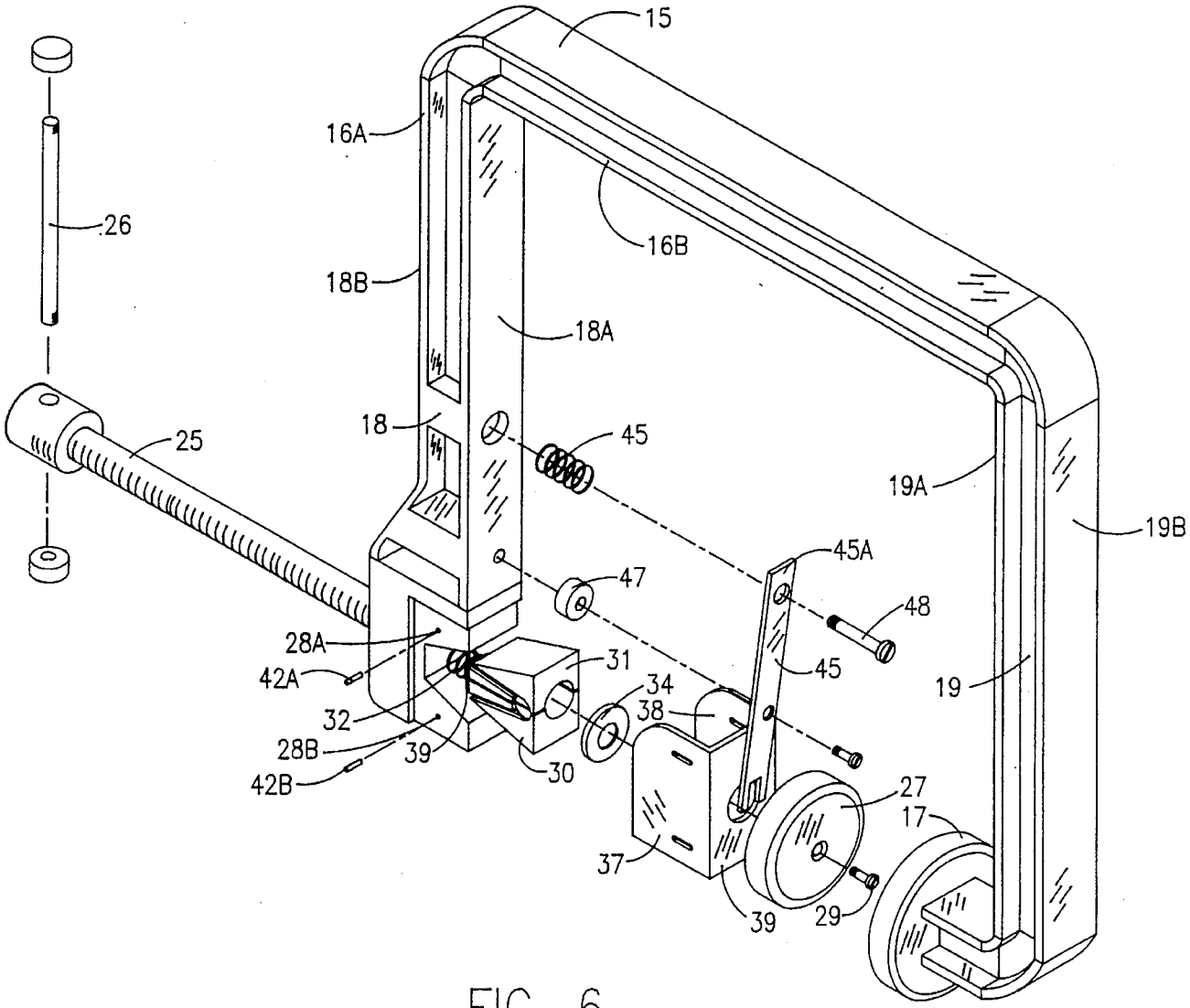
FIG. 6 is an exploded perspective view of the clamping device.

As shown in FIGS. 1, 2, 3, and 6, a conventional second workpiece engaging member 27 preferably a disc-shaped member is complementarily disposed relative to the first workpiece engaging member 17 and is swivelly attached to an end of the threaded rod 25 with a screw 29, the end of the threaded rod 25 being removably and movably disposed between the inner leg 18 and the outer leg. A conventional handle 26 is attached to the opposite end of the threaded rod 25 for moving the rod through the transverse bore 20 which, as shown in FIGS. 2, 3, & 6, has a tapered end portion in the inner side 18*a* of the inner leg 18, which is tapered outwardly toward the outer leg, and which further has a pair of generally wedge-shaped slots in the edge of the wall 22 forming the transverse bore 20 and in the inner side 18*a* of the inner leg 18, the wedge-shaped slots being substantially aligned and opposed to one another. As shown in FIG. 6, the tapered end portion of the transverse bore 20 defines a seat portion 21 which is adapted to receive a spring means 32 which rests against the interior of the wall 22 forming the transverse bore 20 and against a washer 39. The seat portion 21 is also adapted to receive a pair of mirrored rod engageable half bodies 30 & 31; wherein, as shown in FIG. 4, each half body 30 or 31 has four sides; a first 30*a* or 31*a* of which disposedly faces a first side 30*a* or 31*a* of the other half body 30 or 31; a second 30*e* or 31*e* of which opposes the first side 30*a* or 31*a* of the immediate half body 30 or 31 and is tapered inwardly from the front end of the half body 30 or 31 to the rear end of the half body 30 or 31 so that the half bodies 30 & 31 can be conveniently received in the seat portion 21 of the inner leg 18, which is complementarily tapered relative to the second sides 30*e* & 31*e* of the rod engageable half bodies 30 & 31; a third 30*b* or 31*b* of which interconnects the first side 30*a* or 31*a* to the second side 30*e* or 31*e* of the immediate half body 30 or 31 and is generally disposed in a plane with the third side 30*b* or 31*b* of the other half body 30 or 31; and a fourth of which is opposed to the third 30*b* or 31*b* on the immediate half body 30 or 31. A semi-cylindrical groove 30*c* or 31*c* extends in the first side 30*a* or 31*a* and extends from the front end to the rear end of each half body 30 or 31. A spiral or helical ridges are formed in the surface of each of the semicylindrical grooves 30*c* & 31*c*, the spiral or helical ridges being essentially threads 30*d* & 31*d* for threadingly receiving and engaging the rod. The two rod engageable half bodies 30 & 31 are disposed with the first side 30*a* & 31*a* of the two rod engageable half bodies 30 & 31 facing each other and being separably in contact to each other with the grooves 30*c* & 31*c* defining a threaded bore when the rod engageable half bodies 30 & 31 are brought into contact with each other for threadingly engaging the threaded rod 25. The rod engageable half bodies 30 & 31 are adapted and dimensioned to slidably fit and be in contact with each other in the seat portion 21 in the inner leg 18.

As shown in FIGS. 1, 2, 5, & 6, a retaining cover 36 having two side walls 37 & 38, an open back, and a front wall 40 with a hole centered through the front end for receiving the threaded rod 25, slidably fits about the rod engageable half bodies 30 & 31 and substantially fits about the tapered portion of the transverse bore 20 including the wedge-shaped slots in the wall 22 of the transverse bore 20 and further fits in a pair of opposed recessed portions in the inner leg 18 to substantially contain and limit movement of the rod engageable half bodies 30 & 31 which are removably seated in the tapered end portion of the transverse bore 20 and which are biased against the spring means 32 which is biased to urge the rod engageable half bodies 30 & 31 out of the seat portion 21. The retaining cover 36 has a pair of elongated slots 41*a–d* through each of the side walls 37 & 38 near opposed edges of each side wall 37 or 38. The elongated slots 41*a–d* are dimensioned and adapted to receive pins 42*a* & 42*b* which extend through holes 28*a* & 28*b* near the end portion of the inner leg 18 generally parallel to the inner and outer sides 18*a* & 18*b* of the inner leg 18 and which mount the retaining cover 36 to the inner leg 18 and which also limit the movement of the retaining cover 36 which is biasedly disposed about the seat portion 21 of the transverse bore 20 including the wedge-shaped slots in the inner leg 18. A cam washer 34 is disposed in between the retaining cover 36 and the rod engageable half bodies 30 & 31 and has an opening through the cam washer, which is aligned with the hole through the front wall 40 of the retaining cover 36 for receiving the threaded rod 25. The cam washer 34 is urged against the rod engageable half bodies 30 & 31 by the retaining cover 36 and the spring means 32 to generally restrict twisting of the rod engageable half bodies 30 & 31 which further have a slot 30*f* & 31*f* and a hole 30*g* & 31*g* in each of the third sides 30*b* & 31*b*, each slot 30*f* and 31*f* and hole 30*g* & 31*g* being dimensioned and adapted to receive and substantially prevent twisting of a biased element 35 which biases the rod engageable half bodies 30 & 31 away from each other for separating the rod engageable half bodies 30 & 31 in cooperation with the spring means 32 so that the rod engageable half bodies 30 & 31 once urged out of the seat portion 21 by the spring means 32, separate from one another because of the forces exerted by the biased element 35 on the two half bodies 30 & 31. The rod engageable half bodies 30 & 31 are separated from one another by the biased element 35 just enough to threadingly disengage the rod engageable half bodies 30 & 31 from the threaded rod 25 which can be freely moved either toward the outer leg to quickly set the clamping device 10 or away from the outer leg to quickly release the clamping device 10.

As shown in FIG. 6, an elongate and generally flatten detent 45 having a first end 45*a* and a second end 45*b* having a generally semi-circular slot therein is movably attached at an intermediate portion thereof to the inner side 18*a* of the inner leg 18 by a bolt. The detent 45 is mounted to a spacer member 47 through which the bolt extends. The intermediate portion of the detent 45 is spaced from the inner leg 18 by the spacer member 47 such as a washer which provides a teeter-totter effect to the detent 45 by allowing the ends of the detent 45 to be moved toward or away from the inner leg 18. A spring member 46 is positioned in a hole in the inner side 18*a* of the inner leg 18 and is mounted about a support member 48 which extends through the first end 45*a* of the detent 45 and through the spring member 46 which biases the first end 45*a* of the detent 45 away from the inner leg 18 and urges the second end 45*b* of the detent 45 against the exterior of the front wall 40 of the retaining cover 36 and moves the retaining cover 36 in a closed position about the tapered end of the transverse bore 20 and further moves the half bodies 30 & 31 into the seat portion 21 and into contact with one another and into threaded engagement with the threaded rod 25.

To disengage the two half bodies 30 & 31 from the threaded rod 25 so that the threaded rod 25 can be freely moved toward or away from the outer leg, the user can depress the first end 45*a* of the detent 45 toward the inner leg 18, which moves the second end 45*b* of the detent 45 toward the outer leg thus allowing the spring means 32 to urge the half bodies 30 & 31 slightly out of the seat portion 21 and allowing the biased element 35 to separate the two half bodies 30 & 31. The distance in which the retaining cover 36 is allowed to slide toward the outer leg is limited by the pins 42*a* & 42*b* which extend in the slots in the retaining cover 36, so that the half bodies 30 & 31 remain in close proximity to one another and cannot become misaligned to one another. The retaining cover 36 is essentially dimensioned and adapted to house and retain the half bodies 30 & 31. Once the two half bodies 30 & 31 are separated from one another, the user can slide the threaded rod 25 quickly and easily to either set or release the clamping device 10 without the user having to thread the rod through the half bodies 30 & 31. Once the threaded rod 25 is selectively moved by the user, the user can release the first end 45*a* of the detent 45, which becomes biased away from the inner leg 18 by the spring member 46, thus causing the second end 45*b* of the detent 45 to urge the retaining cover 36 in a closed position with the half bodies 30 & 31 being moved into the seat portion 21 and being placed into contact with each other and into engagement with the threaded rod 25. The half bodies 30 & 31 allow the threaded rod 25 to engage and hold a work piece between the first and second work piece engaging members, because the force exerted upon the threaded rod 25 by the work piece is counteracted by the threads 30*d* & 31*d* and the gripping surface in the half bodies 30 & 31 which grippingly hold the threaded rod 25 as it is being threaded toward the outer leg and in engagement with the work piece. This clamping device 10 will save many man hours which are wasted by the user threading in or out the threaded rod 25. Whereas, with this clamping device 10, the user can quickly disengage the threaded rod 25 and set the rod into engagement with the workpiece and then engage the rod with the half bodies 30 & 31 and tighten the rod to clamp the workpiece.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A quick set and release clamping device comprising:

a frame having a first workpiece engaging member and a transverse bore therethrough and further having an inner leg and an outer leg, said inner leg further having an inner side and an outer side, said transverse bore extending through an end portion of said inner leg and further having a tapered end in said inner side of said inner leg, said tapered end defining a seat portion in said transverse bore;

a threaded rod having a handle and capable of being freely moved back and forth through said transverse bore and further having a second work piece enraging member which in cooperation with said first work piece engaging member, is for clamping a work piece therebetween; and a means to threadingly engage and disengage said threaded rod and to effect clamping of said work piece with said threaded rod and further comprising a pair of mirrored half bodies movably and biasedly disposed in said seat portion; a retaining cover for housing said half bodies and for limiting movement of said half bodies; and a detent movably mounted to said inner leg and engagingly biased to said retaining cover to releaseably urge said half bodies into engagement with said threaded rod extending through said transverse bore; each of said half bodies having a front end and a back end and further having at least three sides, a first of which has a threaded groove extending from said front end to said back end and is facing said first side of said other half body, a second of which is opposed to said first side and is tapered from said front end to said back end so that said half bodies are fittingly received and seated in said seat portion, and a third of which has a slot therein and is disposed generally in a plane with said third side of said other half body.

2. A quick set and release clamping device as described in claim 1, wherein said grooves in said seated half bodies substantially define a threaded bore adapted and dimensioned to threadingly receive said threaded rod and to effect clamping of said workpiece by said threaded rod.

3. A quick set and release clamping device as described in claim 2, wherein said means to threadingly engage and disengage said threaded rod further includes a spring means which is disposed in said seat portion for biasedly moving said half bodies generally out of said seat portion.

4. A quick set and release clamping device as described in claim 3, wherein said means to threadingly engage and disengage said threaded rod further comprises a biased element which is received in said slots in said third sides of said half bodies for biasedly separating said half bodies and disengaging said half bodies from said threaded rod in cooperation with said spring means.

5. A quick set and release clamping device comprising:

a frame having a first workpiece engaging member and a transverse bore therethrough and further having an inner leg and an outer leg, said inner leg further having an inner side and an outer side, said transverse bore extending through an end portion of said inner leg and further having a tapered end in said inner side of said inner leg, said tapered end defining a seat portion in said transverse bore;

a threaded rod having a handle and capable of being freely moved back and forth through said transverse bore and further having a second work piece engaging member which in cooperation with said first work piece enraging member, is for clamping a work piece therebetween; and a means to threadingly engage and disengage said threaded rod and to effect clamping of said work piece with said threaded rod, further comprising a pair of mirrored half bodies movably disposed for engaging and disengaging said threaded rod; a retaining cover for housing said half bodies and for limiting movement of said half bodies; and a detent movably mounted to said inner leg and engagingly biased to said retaining cover to releaseably urge said half bodies into engagement with said threaded rod extending through said transverse bore; said means to threadingly engage and disengage said threaded rod further including a pair of pins which are removably extended through said inner leg for movably mounting said retaining cover to said inner leg.

6. A quick set and release clamping device as described in claim 5, wherein said means to threadingly engage and disengage said threaded rod further includes said retaining cover having a front wall, two side walls and an open back through which a portion of said inner leg is received, said front wall having an opening therethrough for receiving said threaded rod, each of said side walls having a pair of slots therethrough, said slots adapted for receiving said pins, said retaining cover slidable on said pins to move said half bodies into said seat portion or to allow said half bodies to move generally out of said seat portion.

7. A quick set and release clamping device as described in claim 6, wherein said half bodies are housed within said retaining cover.

8. A quick set and release clamping device comprising:

a frame having a first workpiece engaging member and a transverse bore therethrough and further having an inner leg and an outer leg, said inner leg further having an inner side and an outer side, said transverse bore extending through an end portion of said inner leg and further having a tapered end in said inner side of said inner leg, said tapered end defining a seat portion in said transverse bore;

a threaded rod having a handle and capable of being freely moved back and forth through said transverse bore and further having a second work piece engaging member which in cooperation with said first work piece engaging member, is for clamping a work piece therebetween; and a means to threadingly engage and disengage said threaded rod and to effect clamping of said work piece with said threaded rod, further comprising a pair of mirrored half bodies movably disposed for engaging and disengaging said threaded rod; a retaining cover for housing said half bodies and for limiting movement of said half bodies; and a detent movably mounted to said inner leg and engagingly biased to said retaining cover to releaseably urge said half bodies into engagement with said threaded rod extending through said transverse bore; said detent being an elongated member having a first end and a second end, said detent being movably mounted at an intermediate portion thereof to said inner leg such that said ends of said detent are capable of moving either toward or away from said inner leg.

9. A quick set and release clamping device as described in claim 8, wherein said intermediate portion of said detent is spaced from said inner leg.

10. A quick set and release clamping device as described in claim 8, wherein said means to threadingly engage or disengage said threaded rod further includes a spring member disposed in said inner side of said inner leg for biasedly urging said first end of said detent away from said inner leg thus effecting movement of said second end of said detent toward said inner leg and against said retaining cover for further effecting movement of said half bodies into said seat portion and into engagement with said threaded rod extending through said transverse bore.

11. A quick set or release clamping device as described in claim 10, wherein said detent has a generally semi-circular slot extending in said second end, said semi-circular slot adapted to receive a portion of said threaded rod so that pressure exerted by said second end on said front wall of said retaining cover is centrally disposed to substantially prevent said retaining cover from binding as it is moved back and forth.

* * * * *